US005224699A

United States Patent [19]

Zaruba

[11] Patent Number: 5,224,699

[45] Date of Patent: Jul. 6, 1993

[54] BASKETBALL GAME

[75] Inventor: John V. Zaruba, Oak Park, Ill.

[73] Assignee: Cap Toys, Inc., Bedford Heights, Ohio

[21] Appl. No.: 901,725

[22] Filed: Jun. 22, 1992

[51] Int. Cl.[5] ..... A63B 63/08; F41J 5/052

[52] U.S. Cl. ..... 273/1.5 R; 273/375

[58] Field of Search ..... 273/1.5 R, 1.5 A, 85 B, 273/371, 387, 402, 411

[56] References Cited

U.S. PATENT DOCUMENTS

| | | | |
|---|---|---|---|
| 2,517,463 | 8/1950 | Cobb | 273/1.5 R |
| 2,999,233 | 9/1961 | Dresbach et al. | 273/1.5 R X |
| 3,756,599 | 9/1973 | Imatt et al. | 273/387 |
| 4,480,833 | 11/1984 | Barcelow et al. | 273/85 B |
| 4,955,605 | 9/1990 | Goldfarb | 273/1.5 A |
| 4,999,603 | 3/1991 | Mele et al. | 273/1.5 R |
| 5,020,806 | 6/1991 | Martin | 273/371 |
| 5,064,195 | 11/1991 | McMahan et al. | 273/1.5 R X |
| 5,133,546 | 7/1992 | Matherne et al. | 273/1.5 A X |

*Primary Examiner*—Paul E. Shapiro

[57] ABSTRACT

A basketball game including two hoops and a backboard that is adapted to be mounted indoors on an interior structure, such as a door. Deflectable paddles detect the passage of balls through the hoop. Each score (passage of a ball through a hoop) generates a reproduced human voice announcement. A microprocessor registers each score and keeps track of the differential between the number of balls passing through each respective hoop. The score differential is displayed along a row of light emitting diodes. The first player to achieve a four hoop differential in his favor is the winner. Two players may compete against each other, or one player may compete against himself. In one player mode, the microprocessor registers random scores for the machine. The frequency of machine scores depends upon the skill level selected by the player.

8 Claims, 3 Drawing Sheets

FIG. 3
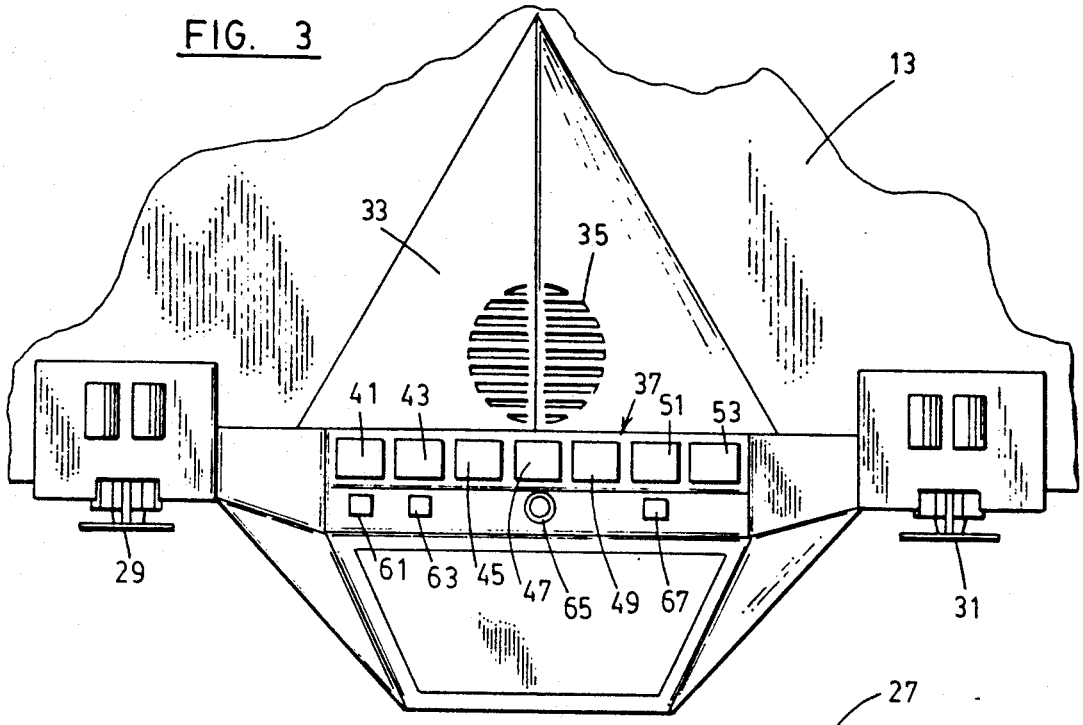
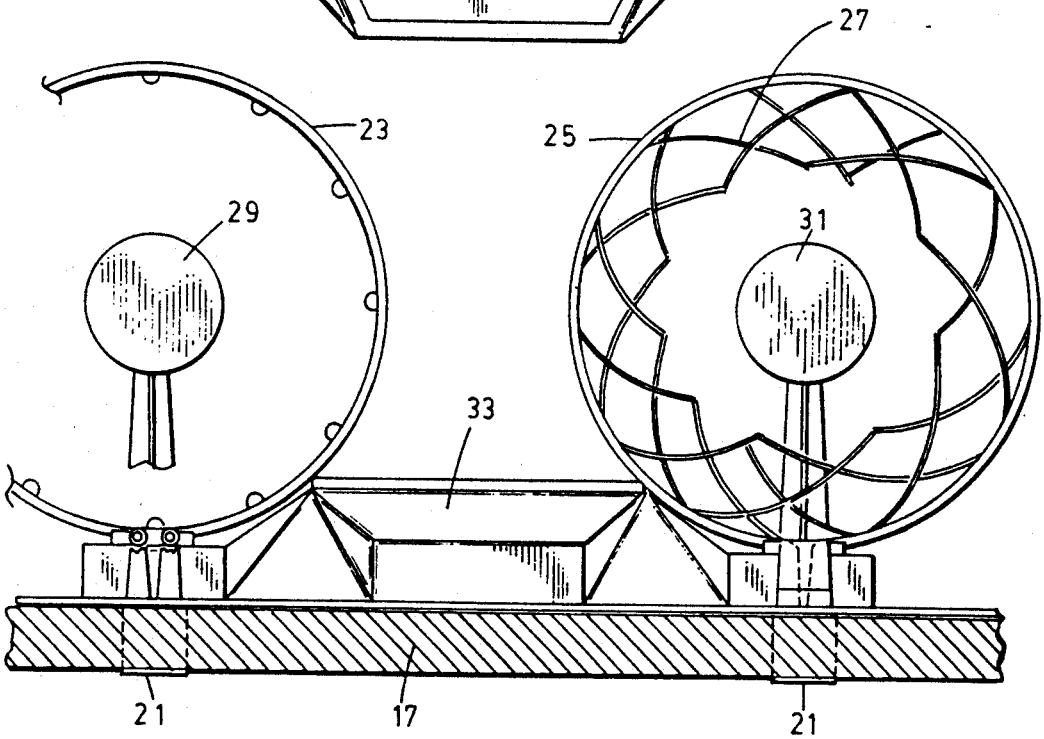
FIG. 4

FIG. 6
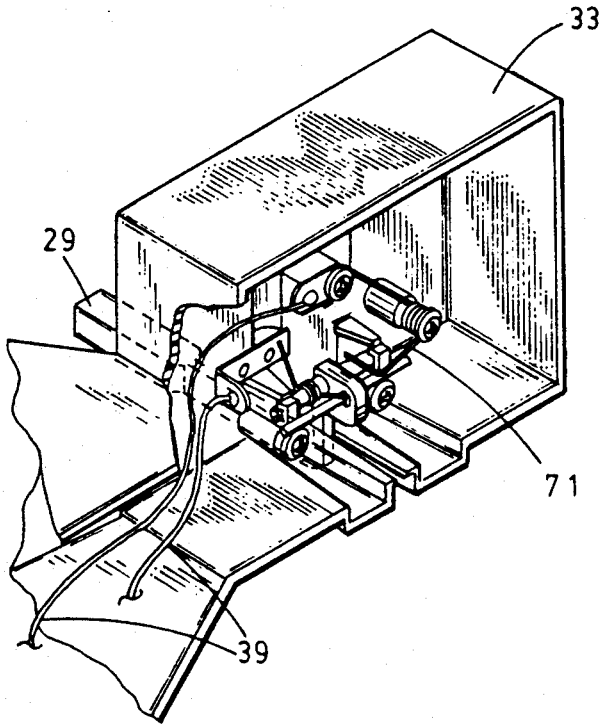
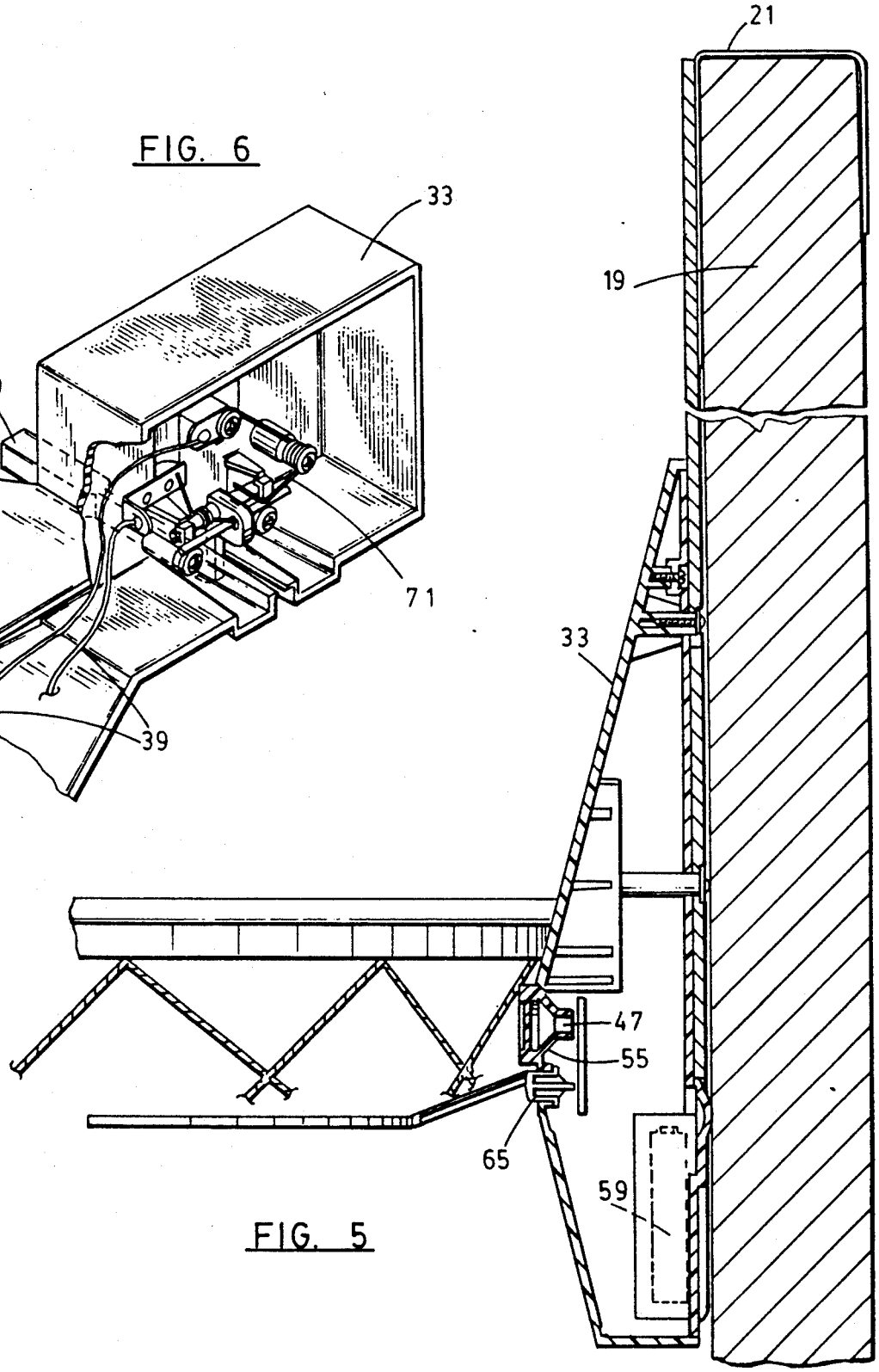
FIG. 5

BASKETBALL GAME

BACKGROUND AND SUMMARY OF THE INVENTION

This invention is directed to a basketball game which allows two players to compete against each other or a single player to effectively compete against himself.

An object of this invention is a basketball game having two hoops and a visual indicator which displays the difference in the number of baskets made through each hoop at a given instance during a game.

Another object of this invention is a basketball game having two hoops, a visual indicator showing the difference in the number of baskets made through each hoop during a game and which also provides an audible signal indicating each time a basket is made through a hoop and an audible signal when a player wins the game.

Another object of this invention is a basketball game having two hoops in which the difficulty of playing the game may be varied by reducing the time interval in which a basket may be scored.

Another object of this invention is a basketball game having two hoops which is adapted to be played indoors and which is easily mounted on an interior structure, such as a door.

Other objects may be found in the following specification, claims and drawings.

BRIEF DESCRIPTION OF THE DRAWINGS

The invention is illustrated more or less diagrammatically in the following drawings wherein:

FIG. 3 is an enlarged, partial, front elevational view of the score indicating device of the game of this invention;

FIG. 4 is an enlarged, partial, bottom cross sectional view of the game of this invention with some parts omitted and others broken away for clarity of illustration; and FIG. 5 is an enlarged, partial, vertical cross sectional view of the game of this invention with some parts broken away and others omitted for clarity of illustration.

FIG. 6 is a cut-away perspective view of one of the scoring devices and an associated switch of the game of this invention with some parts broken away and others omitted for clarity of illustration.

DESCRIPTION OF THE PREFERRED EMBODIMENT

Figure 1:
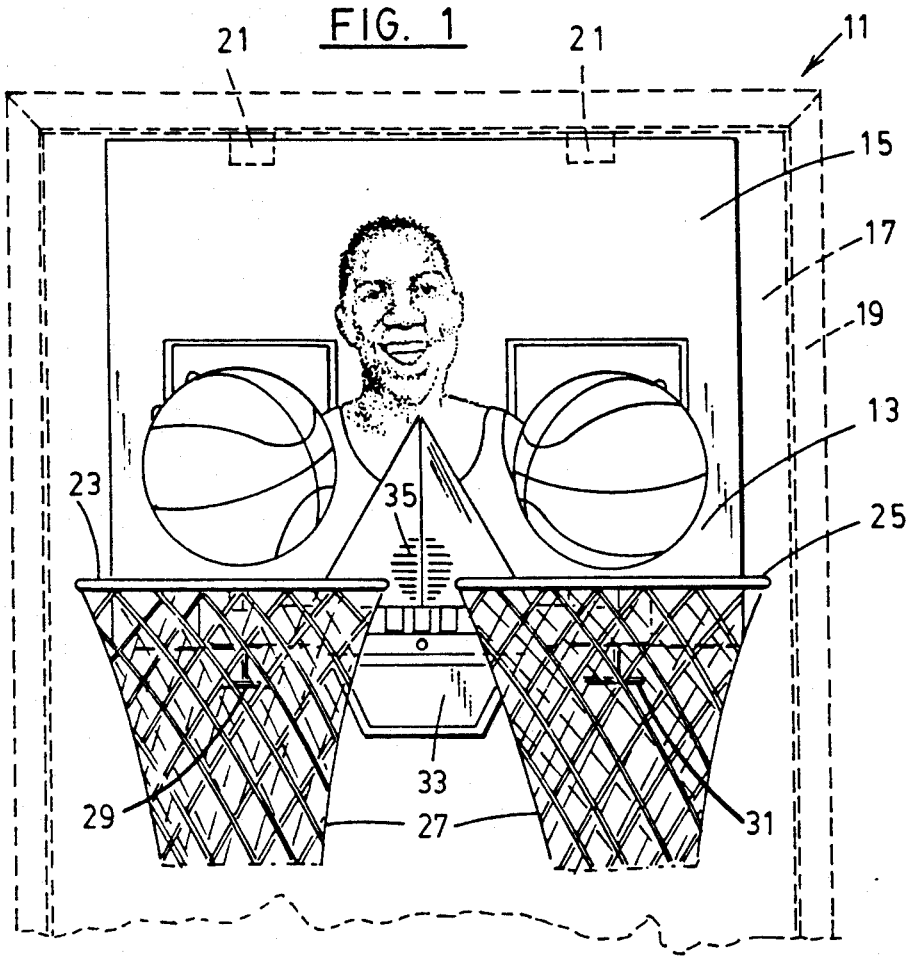
FIG. 1 is a front elevational view of the double hoop basketball game of this invention mounted on a door or other support, a portion of which is shown in phantom lines.

FIG. 1 of the drawings shows a double hoop basketball game 11 of this invention including a backboard 13 of pressboard to which is attached a laminated full color overlie 15 which may contain an illustration of a famous basketball player along with a trademark indicating the source of the game namely, "Double Jam". Backboard 13 is supported on a door 17 mounted in a door frame 19 by means of plastic clips 21 which are shown in FIGS. 1, 4 and 5 of the drawings. Clips 21 are U-shaped and are attached to the back of backboard 13 and fit over the top of door 17 as shown most clearly in FIG. 5 of the drawings.

Basketball hoops 23 and 25 are attached to backboard 13 in a side-by-side arrangement as shown most clearly in FIGS. 1 and 4 of the drawings. Each hoop has a net 27. Paddles 29 and 31 are installed in hoops 23 and 25 respectively to be deflected when a ball passes through its respective hoop.

A housing 33, preferably formed of ABS or HIPS plastic, is mounted on the front surface of backboard 13 between hoops 23 and 25. Mounted on the front of housing 33 is a differential score indicator 37 used to keep track of the baskets made during a game. Speaker openings 35 are formed just above score indicator 37 to allow the passage of audio signals emitted from a speaker contained within housing 33.

Differential score indicator 37 includes seven light emitting diodes (LEDs), 41, 43, 45, 47, 49, 51 and 54, mounted in a row which extends horizontally across the face of housing 33. The position of LEDs 41–53 is shown in FIG. 3. Left-side LEDs 41, 43 and 45 are yellow and right-side LEDs 49, 51 and 53 are red. Center LED 47 is green. Each LED is supported in a cup-shaped housing. By way of illustration, center LED 47 is shown mounted in a housing 55 in FIG. 5. Each housing has a lens of the same color as its associated LED.

Figure 2:
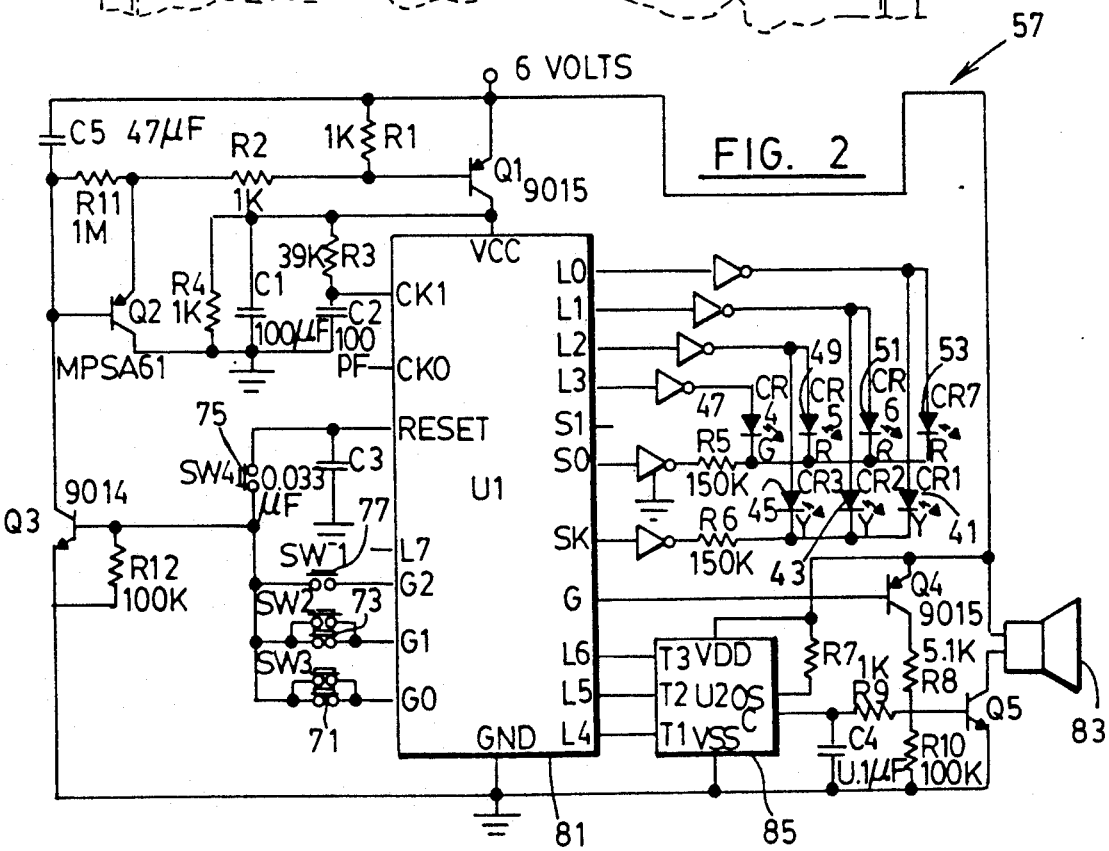
FIG. 2 is a schematic view of the electronic circuitry of the basketball game of this invention.

The LEDs are connected to and receive signals from an electrical circuit 57. The location of LEDs 41–53 within circuit 57 can be seen in FIG. 2, a schematic of circuit 57. A power supply for electrical circuit 57 is mounted within housing 33. The power supply consists of four AA batteries 59 which supply a nominal 6 volts of power to circuit 57.

Four function buttons are mounted on the face of housing 33. Start/reset button 65 is shown in cross section in FIG. 5 of the drawings. This arrangement is typical of the other buttons as well. Button 65 operates switch 75 of circuit 57. One player button 61 operates switch 71 of circuit 57, two player button 63 operates switch 73, and skill level button 67 operates switch 77. During game play, switches 71 and 73 are operated by paddles 29 and 31 (as opposed to one player button 61 and two player button 63). The placement of switch 71 within housing 33 is shown in FIG. 6. Leads 39 connect switch 71 to circuit 57.

First, the control of game play by circuit 57 will be described generally. The centerpiece of circuit 57 is microprocessor 81. The microprocessor used in this embodiment is sold by Thompson Microelectronics under the designation ETL9413N. Microprocessor 81 receives input from three sources: the switches 71–77 (RESET port and ports G0-G2); the power supply (Vcc port); and the clocking circuitry (CK1 port). Input from switches 71–77 will occur in response to operation of the function buttons or upon actuation of paddles 29 and 31 (i.e. a made basket).

In response to signals received from the switches, appropriate signals are relayed to LEDs 41–53. Illumination of an LED occurs by the placement of appropriate signals at output ports L0-L3, S0 and SK. Thus, any player unput (function button or made basket) will be followed by a visual response in the form of illumination of certain LEDs.

Many player inputs are also followed by an audio response. Microprocessor 81 relays instructions to a special microprocessor 85 as to which audio signal should be played. Ultimately, this depends upon which of the switches have been actuated. Microprocessor 85, which in this embodiment is a Mosel chip provided by Technomind Sound under the designation MSS0602, then relays the appropriate audio signals to speaker 83.

Circuit 57 also contains various basic circuit elements (resistors, capacitors, transistors). Each element is clearly labeled with its corresponding value (i.e., resistance, capacitance). The arrangement and placement of these elements is self-explanatory from FIG. 2 and will be understood by one skilled in the art.

Now for a more specific description of game operation. Before or during game play, when no switches have been actuated for a period of two to four minutes, microprocessor 81 reverts to a resting state, drawing only a minimum current (approximately 0.004 mA). The game is activated by the depression of start/reset button 65. Switch 75 is actuated, causing a signal to appear at the RESET port of microprocessor 81. This causes microprocessor 81 to reset and power-up (load to 6 volts). Start/reset button 65 may be used to reset the game at any time during game play.

Yellow LEDs 41-45 and red LEDs 49-53 are flashed alternately to signal to the player(s) that the game is ready for play. Alternate flashing is accomplished in the following manner. First, signals are output on ports SK, L1, L2 and L3 to result in a positive voltage across and subsequent illuminating of yellow LEDs 41-45. Second, signals are output on ports S0, L1, L2 and L3 to result in a positive voltage across and subsequent illumination of red LEDs 49-53. Flashing repeats in this fashion until either one player button 61 or two player button 63 is pressed. If neither is pressed within two to four minutes, the game deactivates.

A player desiring to play by himself should press one player button 61. This causes the actuation of switch 71 and the appearance of a signal at port G0. Microprocessor 81 then outputs signals on ports L0 and SK to result in a positive voltage across and illumination of yellow LED 41. As LED 41 is located immediately above one player button 61, the player can see that the game is ready for one player play.

Also illuminated is LED 49, 51 or 53, which will correspond to the current skill level. Initially left red LED 49 is illuminated to indicate the default skill level (level 1). The skill level may be changed by use of skill level button 67. Button 67 actuates switch 77, causing a signal to appear at port G2 of microprocessor 81. Each time button 67 is pressed, the skill level is increased by one. A corresponding LED is illuminated to display the current skill level to the player: left red LED 49 for skill level 1 (output signals at S0 and L2); middle red LED 51 for skill level 2 (output signals at S0 and L1); or right red LED 53 for skill level 3 (output signals at S0 and L0). If skill level button 67 is pressed at skill level 3 (hardest level), the skill level is "rolled back" to skill level 1 (easiest level).

Three seconds are allowed for the player to initially press skill level button 67 and three seconds are allowed after each depression of button 67 (to allow the player to complete or change his selection). After three seconds have passed, game play begins. If no skill level has been selected, the game is played at skill level one by default.

The setting of the skill level determines the frequency at which the machine-opponent will score. At level one, six to twenty-six seconds elapse between machine scores (randomly determined by microprocessor 81). At level two, three to fourteen seconds elapse between machine scores and at level three, two to seven second elapse between machine scores.

Two player play is identical to one player play, except that instead of the machine randomly scoring, there is an actual player to compete against. The two player option is selected by pressing two player button 63. Switch 73 is actuated and a signal appears at port G1 of microprocessor 81. Middle yellow LED 43 is illuminated (output signals at ports L1 and SK) to indicate two-player mode. After a one second delay, game play beings. It should be noted that pressed skill level button 67 during two player play has no effect.

Game play begins after a player mode (one or two players) has been selected. To signal the start of the game, green LED 47 is briefly illuminated (output signal sat ports S0 and L3) and an audio signal is sent to speaker 83 via microprocessor 85 to play four beeps.

In both one and two player modes, the object is to cause as many balls to pass through hoops 23 and 25 as quickly as possible. In one player games, the player shoots at left hoop 23 and competes against the random scores of the machine-opponent. In two-player games, one player shoots at hoop 23 and the other player shoots at hoop 25. In either game the first player to pass four more balls through the hoop than his opponent is the winner.

Passage of a ball through hoop 23 actuates paddle 29 and passage of a ball through hoop 25 actuates paddle 31. Actuation of paddle 29 closes switch 71 an actuation of paddle 31 closes switch 73. Microprocessor 81 registers a score for the appropriate player. In one player mode, scores are randomly registered for the machine (depending on the selected skill level).

Rather than keeping a running total of the number of scores by each player, microprocessor 81 tabulates the differential score: the difference between the number of scores by the first player and the number of scores by the second player of the machine. The differential score is displayed on differential score indicator 37 by illuminating LEDs in the following manner:

| Differential Score | Illuminated LED | Active Output Ports |
|---|---|---|
| player one ahead by three | left yellow LED 41 | SK, L0 |
| player one ahead by two | middle yellow LED 43 | SK, L1 |
| player one ahead by one | right yellow LED 45 | SK, L2 |
| tie/start of game | green LED 47 | S0, L3 |
| player two/machine ahead by one | left red LED 49 | S0, L0 |
| player two/machine ahead by two | middle red LED 51 | S0, L1 |
| player two/machine ahead by three | right red LED 53 | S0, L2 |

Each time player one scores, the lighted LED will appear to move to the left along differential score indicator 37. Each time player two or the machine scores, the lighted LE will appear to move to the right along score indicator 37. Each score is accompanied by a simulated voice announcement thru speaker 83. When player one scores, "good" is announced; when player two or the machine scores, "yes" is announced.

The game is won when a player gains a four hoop lead (differential of four). Visually, for player one, this will consist of a score when left yellow LED 41 is illuminated. For player two, it will consist of a score when right red LED 53 is illuminated. A won game is followed by a simulated buzzer sound. The result is displayed for 30 seconds, and the game is deactivated.

I claim:

1. A basketball game including:

a backboard;

a pair of basket hoops mounted side by side on said backboard;

means to detect the passage of balls through said hoops;

means to compute the differential between the number of balls passing through each of said hoops;

means to display said differential consisting of the illumination of particular light emitting diodes arranged along a differential score indicator.

2. The basketball game o claim 1 wherein said means to detect the passage of balls through said hoops consist of deflectable paddles mounted in or below each hoop in a position to be deflected downwardly when a ball passes through said hoop.

3. The basketball game of claim 1 wherein said means to compute the differential between the number of balls passing through each of said hoops consists of a programmed microprocessor which receives a signal each time a ball passes through one of said hoops and keeps a running total of the difference between the total number of signals received from each hoop.

4. The basketball game of claim 1 further characterized by eh emission of an audio signal each time passage of a ball through on of said hoops is detected.

5. The basketball game of claim 4 wherein said audio signals consist of reproductions of the human voice and wherein the passage of a ball through a particular hoop generates a voice signal unique to that hoop.

6. The basketball game of claim 1 further characterized by an audio signal indicating the end of the game when said differential reaches a predetermined value.

7. The basketball game of claim 1 further characterized by means of mounting said backboard on a door.

8. The basketball game of claim 7 wherein said means of mounting said backboard on a door consists of clips attached to the top of said backboard.

* * * * *